US005276933A

United States Patent [19]

Hennessey et al.

[11] Patent Number: 5,276,933

[45] Date of Patent: Jan. 11, 1994

[54] DAMAGE RESISTANT RECIRCULATION FLAP

[75] Inventors: Robert D. Hennessey, Golden Valley; Michael S. Wilmo, Crystal, both of Minn.

[73] Assignee: Tennant Company, Minneapolis, Minn.

[21] Appl. No.: 909,222

[22] Filed: Jul. 2, 1992

[51] Int. Cl.[5] ..... E01H 1/04

[52] U.S. Cl. ..... 15/83; 15/246

[58] Field of Search ..... 15/79.1, 79.2, 82–86, 15/340.3, 340.4, 246

[56] References Cited

U.S. PATENT DOCUMENTS

| | | | |
|---|---|---|---|
| 1,537,003 | 5/1925 | Bryant | 15/83 |
| 2,268,059 | 12/1941 | Parker et al. | 15/83 |
| 2,782,435 | 2/1957 | Stone | 15/83 |
| 3,093,853 | 6/1963 | Tamny | 15/83 |
| 3,112,593 | 12/1963 | Ronning | 15/83 |

FOREIGN PATENT DOCUMENTS

| | | | |
|---|---|---|---|
| 0642543 | 9/1950 | United Kingdom | 15/79.1 |
| 1097670 | 1/1968 | United Kingdom | 15/79.1 |

*Primary Examiner*—Edward L. Roberts

*Attorney, Agent, or Firm*—Kinzer, Plyer, Dorn, McEachran & Jambor

[57] ABSTRACT

A surface maintenance machine includes a cylindrical brush mounted in the machine for rotation about a generally horizontal axis extending transverse to the direction of machine movement. A recirculation flap is attached to the machine and extends generally coextensively with the brush and parallel thereto. The recirculation flap is normally yieldingly urged toward the brush, with contact between the flap and a floor obstacle causing the flap to move, against the force of its mounting springs, away from the brush.

5 Claims, 3 Drawing Sheets

28
26
49
50
38
53
51
44
50A
42
40
48
34
32
36
30
24

28
52
50
32
49
26
53
38
51
34
36
44
42
30
40
48
54
24

DAMAGE RESISTANT RECIRCULATION FLAP

BACKGROUND OF THE INVENTION

A brush-type sweeper uses a cylindrical brush rotating about a horizontal axis to sweep debris from a surface and throw it into a debris hopper on the machine. The efficiency of this throwing action is never quite 100 percent, though, and a small percentage of the swept debris follows a path around the circumference of the brush, up and over it and into the space behind it. The exact causes of this circumferential travel are not well understood, but the fact that it happens is well known.

Early brush-type sweepers left this overthrown debris behind them in an unsightly fashion on the swept surface. Then it was found that if the rear wall of the brush housing was extended down nearly to the floor and sloped forward under the lower part of the cylindrical brush and as close as possible to it, most of the overthrown debris could be deflected into the brush, whch would recirculate it and throw most of it into the debris hopper. Thus the recirculation flap, as this sloping rear wall was called, substantially improved the sweeping efficiency of the machine. Consequently recirculation flaps have been in common use for many years.

One problem in using sweeping machines is that there are often high areas on floors, such as lifted concrete slabs, speed bumps, ramp crests etc., which project up and can damage machine parts close to the floor. This problem has been especially troublesome with recirculation flaps, because they are not only close to the floor, but they point forward and they extend across nearly the full width of the machine, so they tend to catch on any floor projection anywhere in the path of the machine. They generally consist of a strip of stiff rubber sheet stock extending forward and down from the rear wall of the brush housing, with the rear edge of the flap being bolted to a flange at the lower edge of the housing. This steel flange must be fairly close to the floor to support the flap in a position where it will be effective. When a low floor projection is encountered, the rubber flap may catch on it and bend back without damage, then flip forward into position again after the projection is past. A higher projection, however, will often catch the steel housing flange, with the usual result that the rear brush housing wall is bent out of shape, the recirculation flap is distorted or torn off, and an expensive repair job is needed to restore the machine to good working condition.

From all of this it will be evident that there is a long standing and unsolved need for a recirculation flap and mounting means for it that can withstand floor projections as high as a speed bump without being damaged and remain functional after encountering such projections. The present invention is directed toward that end.

SUMMARY OF THE INVENTION

In the present invention there is a sweeper having a recirculation flap which is located the same and serves the same function as the recirculation flap in the prior art. However, it is not attached solidly to the rear wall of the brush housing as in the prior art. Instead, it is attached to an intermediate bracket which extends laterally across the brush housing. This bracket is attached to the brush housing in a hinged manner, and is held in its operating position by one or more springs or other resilient means. In this position it supports the recirculation flap in the same position as it had in the prior art, so that functionally it performs the same as it did then.

The hinge points where the bracket is attached to the brush housing are so chosen that a force from the front applied high up on the recirculation flap or on the bracket will cause the bracket to pivot back and up. When the recirculation flap encounters a low floor projection the flap will be pushed back, which may provide enough clearance for the low projection to pass under the flap, after which the flap will snap back to normal. However, a higher projection striking the flap higher up will cause the bracket to pivot back and up, carrying the flap up with it, so that greater clearance will be provided under it, and the higher floor obstacle will pass through without damaging anything. After it is past the obstacle the resilient means attached to the bracket will pivot it back into its original position. That will locate the recirculation flap as it was before the floor projection was encountered, so the flap will again operate in its normal manner.

DETAILED DESCRIPTION OF THE INVENTION

Figure 1:
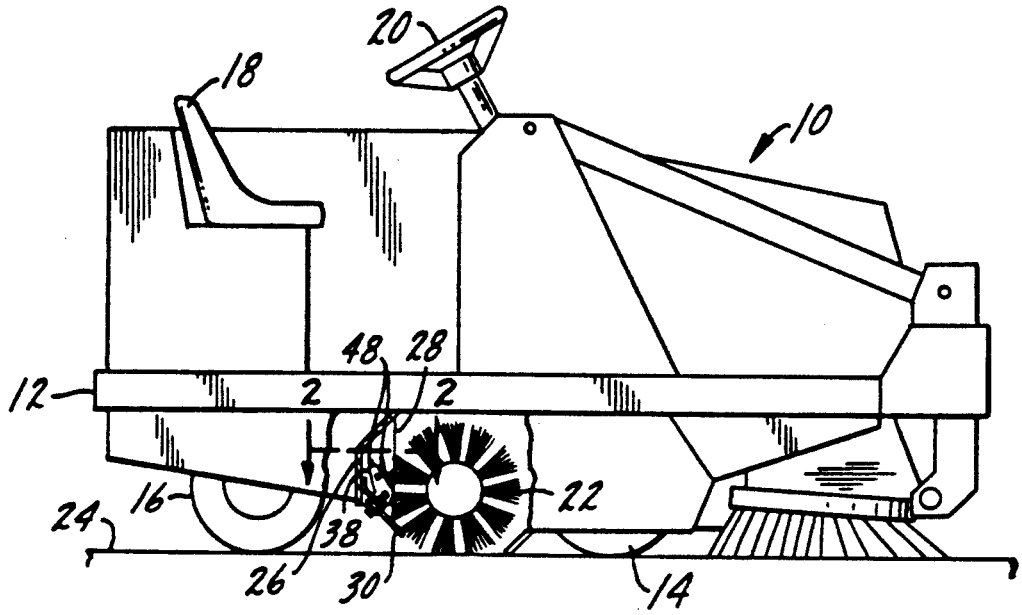
FIG. 1 shows a typical sweeper having a recirculation flap installed in it according to the preferred embodiment of the invention.

Referring to FIG. 1, there is shown at 10 a typical riding type industrial sweeper on which the present invention has been advantageously installed. The sweeper 10 is entirely conventional except for the presence of the invention. The sweeper has a frame 12, and is supported by two front wheels 14 (only one shown) and one rear wheel 16, which also drives and steers the machine. There is a seat 18 and a steering wheel 20 for use by an operator. Sweeping brush 22 is entirely conventional. It contacts the floor or other surface 24 being swept. Many other features of the sweeper are not related to the present invention and so are not shown, or if shown will not be mentioned, as they are well known in the art. We will continue by discussing features which are related to the present invention.

Still referring to FIG. 1, a housing for brush 22 is only partially shown, but its rear wall is 26, and the housing has two partial end walls 28 (only one shown). The brush housing is a structural part of the frame 12 of the sweeper. There is a recirculation flap 30, the purpose and function of which were described earlier. These parts are pointed out on FIG. 1 to locate them in their relationship to the sweeper as a whole, but their detailed construction can be seen better in FIGS. 2 and 3, which are drawn to a larger scale.

Figure 2:
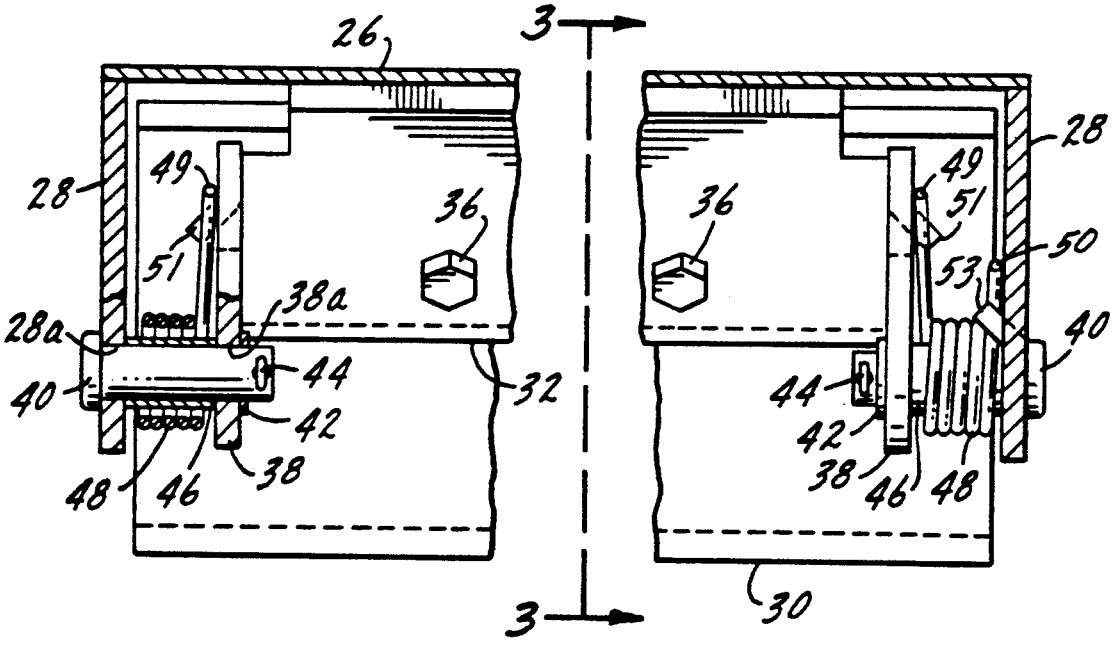
FIG. 2 is a section taken on line 2—2 of FIG. 1.
Figure 3:
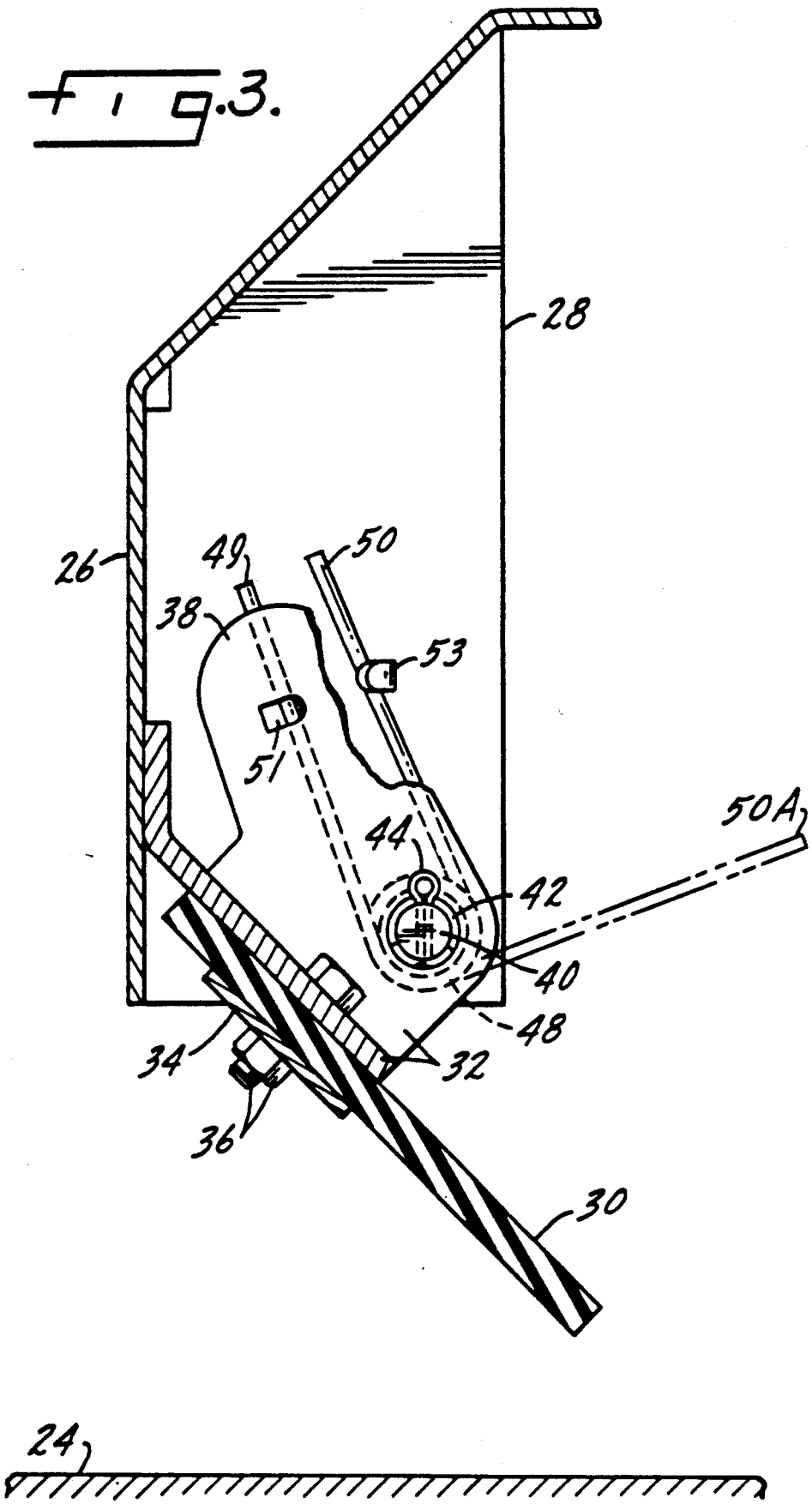
FIG. 3 is a section taken on line 3—3 of FIG. 2.

Referring to FIGS. 2 and 3, there is a bracket 32 to which recirculation flap 30 is attached by means of retainer strip 34 and four bolts and nuts 36 (one or two shown). This assembly is essentially as long as brush 22 and extends transversely across the machine. It will be noticed that bracket 32 has ears 38 at both ends which are bent at 90 degrees from the central part of the bracket and are an integral part of the bracket. These ears make it possible to attach the assembly of bracket 32 and flap 30 to the partial end walls 28 of the brush housing in a hinged manner. This is done by providing a hole 38a in each bracket ear 38 and a hole 28a in each partial end wall 28. The bracket and flap assembly is placed between the partial end walls and the aforementioned holes are aligned, as best seen in FIG. 2. Two clevis pins 40 are inserted through the aligned holes 28a and 38a to serve as hinge pins and are retained with washers 42 and cotter pins 44. The assembly of bracket 32 and recirculation flap 30 is then free to pivot through a range of motion that can be seen by comparing the positions of these parts in FIG. 3 and in FIG. 4.

The assembly of bracket 32 and flap 30 is located between the partial end walls 28 of the brush housing by two spacers 46 around the clevis pins 40. The spacers 46 are surrounded by two torsion springs 48. The inboard legs 49 of these springs are held by tabs 51 extending out from the bracket ears 38, while the outboard spring ends 50 are held by tabs 53 extending in from the partial end walls 28 of the brush housing. When these springs are in a free state the outbord legs 50 are in a position shown in dashed lines as 50A in FIG. 3. Thus, it will be seen that when they are installed they are under considerable preload. As seen in FIG. 3, this preload exerts a counterclockwise force around clevis pin 40 on bracket ear 38, which holds bracket 32 firmly in contact with the rear wall 26 of the brush housing. This will hold recirculation flap 30 in the proper position to serve its intended function during a normal sweeping operation.

Figure 4:
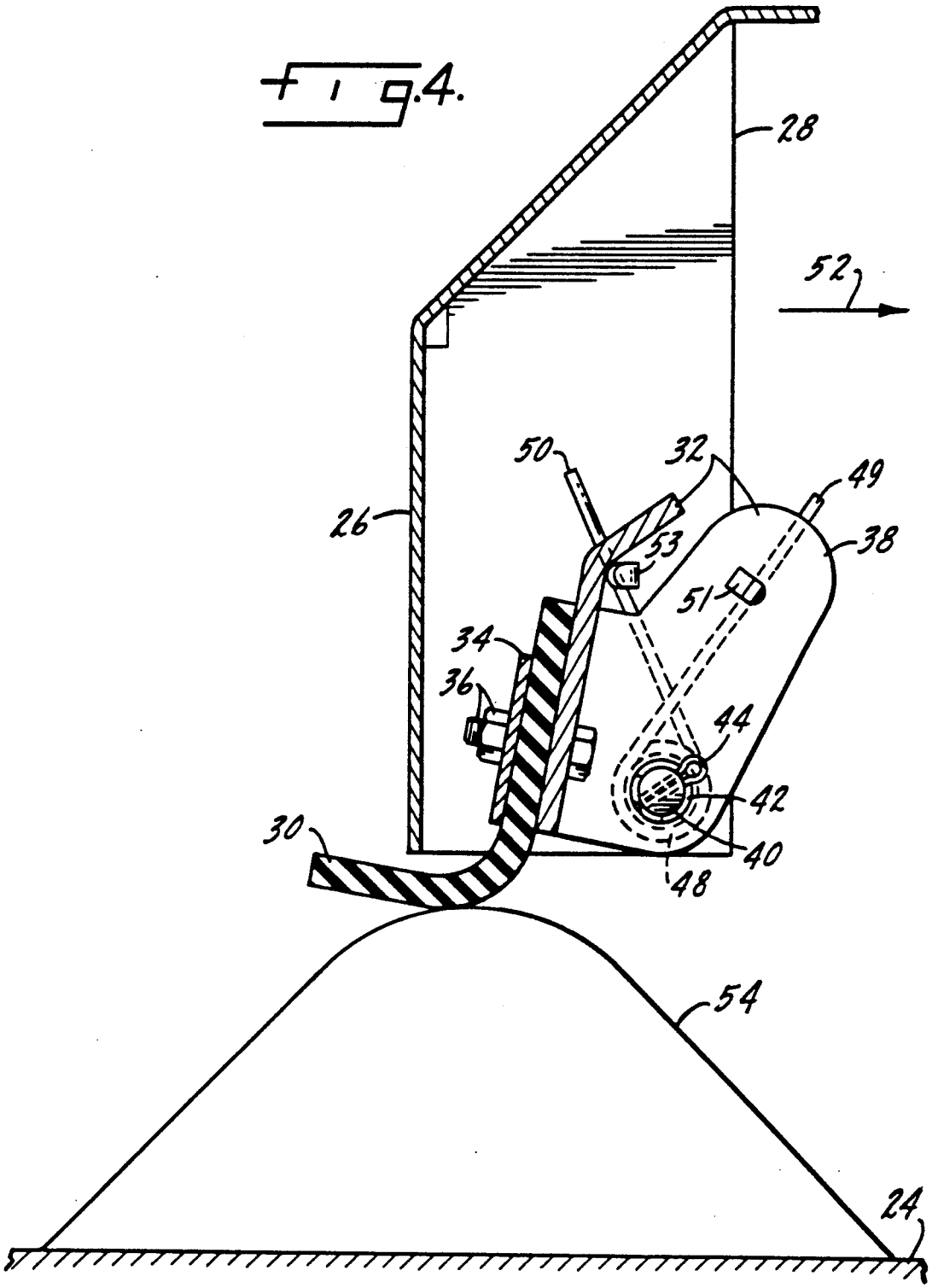
FIG. 4 is a section similar to FIG. 3, showing the action of the recirculation flap in passing over a speed bump.

FIG. 4 shows how the present invention operates when the sweeper, which is moving in the direction of arrow 52, encounters a substantial floor projection, e.g. such as speed bump 54. Recirculation flap 30 and bracket 32 have contacted speed bump 54. The force of the contact has overcome the springs 48 and rotated the flap and bracket clockwise around clevis pin 40 to the position shown, which allows the sweeper to pass over the speed bump without damage to any parts. After the sweeper passes the speed bump the springs 48 will rotate the bracket and flap counterclockwise back to the normal sweeping position shown in FIG. 3.

Whereas the preferred form of the invention has been shown and described, it should be understood that suitable additional modifications, changes, substitutions and alterations may be made without departing from the invention's fundamental theme. It is therefore wished that the invention be unrestricted except as by the appended claims.

The embodiments of the invention in which an exclusive property of privilege is claimed are defined as follows:

1. In a sweeping machine having a cylindrical brush that rotates around a horizontal axis, a means for mounting a recirculation flap behind the cylindrical brush with the recirculation flap being attached to a portion of the mounting means, and with the recirculation flap and the mounting means being attached to the structure of the sweeping machine by one or more pivotal connections and held in normal operating positions by resilient means, characterized in that the pivotal connections are essentially above and forward of that portion of the mounting means to which the recirculation flap is attached whereby contact with a floor obstacle causes the recirculation flap to rotate in an arc upwardly and rearwardly away from said floor obstacle.

2. The sweeping machine of claim 1 in which the one or more pivotal connections comprise one or more hinges having a common axis of rotation.

3. The sweeping machine of claim 1 in which the recirculation flap is comprised of a rubber-like material.

4. A surface maintenance machine adapted to be moved over a surface being maintained and including a brush housing, a cylindrical brush mounted in said housing for rotation about a generally horizontal axis extending transverse to the direction of machine movement, a bracket within said housing, a recirculation flap mounted to said bracket and extending generally coextensively with said brush and parallel thereto, means pivotally mounting said bracket and recirculation flap to said housing including a pin at each end of said bracket, said pins extending through said bracket and housing, a coil spring positioned about each pin and located between facing portions of the bracket and housing, with portions of said spring contacting said housing and bracket to normally bias said recirculation flap and a point of the bracket adjacent thereto toward said brush, with contact of a floor obstacle by said recirculation flap and/or bracket portion causing said bracket portion and flap to move, against the force of said springs, away form said brush.

5. The surface maintenance machine of claim 4 further characterized in that during the said movement of said portion of said bracket the entire bracket remains forward of a rear wall of the brush housing.

* * * * *